US006360661B1

(12) United States Patent
Cheung

(10) Patent No.: US 6,360,661 B1
(45) Date of Patent: Mar. 26, 2002

(54) PRE-INKED HAND STAMP

(75) Inventor: Wo-Man Cheung, Singapore (SG)

(73) Assignee: Ho Feng Enterprise Pte Ltd., Singapore (SG)

( * ) Notice: Subject to any disclaimer, the term of this patent is extended or adjusted under 35 U.S.C. 154(b) by 0 days.

(21) Appl. No.: 09/498,245

(22) Filed: Feb. 3, 2000

(51) Int. Cl.[7] ..... B41K 1/42
(52) U.S. Cl. ..... 101/333; 101/405
(58) Field of Search ..... 101/333, 334, 101/479, 405, 406, 368, 103, 364; 400/460

(56) References Cited

U.S. PATENT DOCUMENTS

| | | | | |
|---|---|---|---|---|
| 1,179,979 A | | 4/1916 | Troup | |
| 1,196,512 A | | 9/1916 | Brookman | |
| 2,900,902 A | | 8/1959 | Becker | |
| 4,172,419 A | | 10/1979 | Munyon | |
| 4,203,362 A | | 5/1980 | Underwood et al. | |
| D266,257 S | | 9/1982 | Ahrens | |
| 4,362,101 A | | 12/1982 | Ahrens | |
| 4,594,943 A | | 6/1986 | Nettesheim et al. | |
| 4,649,819 A | * | 3/1987 | Voto, Jr. et al. | 101/327 |
| 4,735,143 A | | 4/1988 | Weir | |
| 5,111,745 A | | 5/1992 | Wilson | |
| 5,115,729 A | * | 5/1992 | Beckman et al. | 101/327 |
| 5,123,349 A | * | 6/1992 | Beaver et al. | 101/333 |
| 5,261,325 A | | 11/1993 | Bengtsson | |
| D352,521 S | | 11/1994 | Sculler et al. | |
| 5,377,599 A | | 1/1995 | Wall et al. | |

* cited by examiner

*Primary Examiner*—John S. Hilten
*Assistant Examiner*—Darius N. Cone
(74) *Attorney, Agent, or Firm*—Galgano & Burke

(57) ABSTRACT

A pre-inked hand stamp includes a platen carrying a microporous imaging member on its lower portion and having a centrally located threaded stem extending upward from its upper portion; an upper case member having an open bottom and a centrally located opening in its top, the stem of the platen extending through the centrally located opening; a spring and an adjustable stopping assembly coaxially mounted on the stem; and a handle threadably coupled to the end of the stem. The adjustable stopping assembly includes: a lower base member which is mounted in the central opening of the upper case member, a rotatable member which is mounted on the lower base member, and an upper threaded member which is mounted in the rotatable member, engaging it with a spline and groove structure. Rotation of the rotatable member causes rotation of the upper threaded member which results in movement of the upper threaded member along the threaded stem. This moves the upper portion of the threaded member relative to the rotatable member changing the permissible stroke of the handle. The fact that the upper threaded member engages the interior of the rotatable member with a spline and groove arrangement prevents lateral movement of the stem relative to the upper case member.

12 Claims, 3 Drawing Sheets

PRE-INKED HAND STAMP

BACKGROUND OF THE INVENTION

1. Field of the Invention

This invention relates to a pre-inked hand stamp of the kind making use of an imaging member having a microporous structure impregnated with ink and capable under compression of releasing ink gradually so that imprints can be made of indicia, or type elements, presented in relief on the imaging member. More particularly, the invention relates to several improvements in such as hand stamp which provide for a more stable operation and a more even imprint.

2. State of the Art

Pre-inked hand stamps typically include a platen to which an imaging member is fixed, a case that houses the platen, a handle disposed over the case and a shaft or stem interconnecting the handle and the platen. A spring holds the handle assembly in an upward position with the platen and an imaging member entirely inside the case. The handle assembly is displaceable downward against the spring by pressure of a user's hand on the handle so that the imaging member will mark a surface underlying the case. The distance of downward travel, or stroke, of the handle assembly is limited by abutment of a stop member carried with the handle against a stop member supported by the case, and at least one of these stop members is made adjustable in location lengthwise of the stem so that the permitted stroke length of the assembly can be changed when need occurs. A light imprint results if the downward stroke does not compress the stamp indicia sufficiently, while an overly dark or smudged imprint may result if the indicia are compressed too much.

Generally, as ink is depleted from the microporous imaging member, it is desirable to lengthen the stroke to create a darker image. It is important, too, that inadvertent or unintended changes of the stroke adjustment of the handle assembly be avoided.

Since users of a hand stamp will press its handle downward with forces that vary greatly in magnitude and also vary in direction from straight up and down, the quality of the imprints to be obtained in uses of the stamp is influenced by the degree to which its structures will function correctly regardless of the magnitude and the angle of the force applied to the handle by a user.

U.S. Pat. No. 5,377,599 discloses a pre-inked hand stamp which includes a platen carrying a microporous imaging member, a case housing the platen and imaging member, a handle extending upward of the case, and a stem interconnecting the handle with platen, forming a movable assembly. A spring is mounted about the stem between the handle and the case thereby biasing the platen in an upward position inside the case. A stop member inside the handle and a coacting stop member seated relative to an upper portion of the case are spaced apart when the spring biases the platen upward. Upon downward displacement of the handle, the stops abut each other to limit such displacement. One of the stop members is adjustable in location lengthwise of the stem to change the permitted distance of displacement. Several different arrangements are shown for adjusting the location of one of the stops.

Disadvantages of the '599 patent are that the assembly is somewhat complex making assembly difficult, and that lateral movement of the stem and handle relative to the case is not adequately prevented. Several other structural elements of the stamp operate to result in an uneven stamping.

SUMMARY OF THE INVENTION

It is therefore an object of the invention to provide a pre-inked hand stamp which is relatively simple in construction and relatively easy to assemble.

It is also an object of the invention to provide a pre-inked hand stamp which limits lateral movement of the stem and handle relative to the case.

It is another object of the invention to provide a pre-inked hand stamp which incorporates other structural features which operate to provide a more even stamping.

In accord with these objects which will be discussed in detail below, the pre-inked hand stamp of the present invention includes a platen carrying a microporous imaging member on its lower portion and having a centrally located threaded stem extending upward from its upper portion; an upper case member having an open bottom and a centrally located opening in its top, the stem of the platen extending through the centrally located opening; a spring and an adjustable stopping assembly coaxially mounted on the stem; and a handle threadably coupled to the end of the stem.

According to the invention, the adjustable stopping assembly includes three members: a lower base member which is mounted in the central opening of the upper case member, a rotatable member which is mounted on the lower base member, and an upper threaded member which is mounted in the rotatable member. The spring is mounted between the upper threaded member and the lower rotatable member.

The lower base member is a stepped cylinder, the lower portion of which has a spline which engages a groove in the central opening of the upper case member. A step on the lower base member is provided with at least one click-stopping bump. The rotatable member is a cylinder with a lower knurled flange and a base having a plurality of click-stopping depressions. The interior surface of the rotatable member is provided with at least one vertical groove. The upper threaded member is a stepped cylinder, the lower portion of which is dimensioned to fit inside the rotatable member and is provided with at least one spline which engages the at least one vertical groove. The upper portion of the threaded member has a diameter which prevents it from entering the rotatable member and has a threaded opening which engages the threaded stem. The handle has a threaded boss which engages the stem and which is received by a depression in the upper portion of the threaded member.

Rotation of the rotatable member, by gripping the knurled flange, causes rotation of the upper threaded member, by virtue of the spline and groove coupling, which results in movement of the upper threaded member along the threaded stem. This moves the upper portion of the threaded member relative to the rotatable member changing the permissible stroke of the handle.

The fact that the upper threaded member engages the interior of the rotatable member with a spline and groove arrangement prevents lateral movement of the stem relative to the upper case member. The click-stopping bump(s) and the click-stopping depressions prevent unintended rotation of the rotatable member and provide an audible indication of the magnitude of the change of stroke.

According to additional aspects of the invention, the imaging member is provided with rounded edges; the platen is reinforced with orthogonal ribs; and the handle is provided with a concavity which allows the stamp to stand upside down on the handle. As with other hand stamps of this type, the assembly also preferably includes a lower case member which snap-fits to the bottom of the upper case member to prevent dirt from damaging the imaging member when not in use and to inhibit evaporation of ink.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
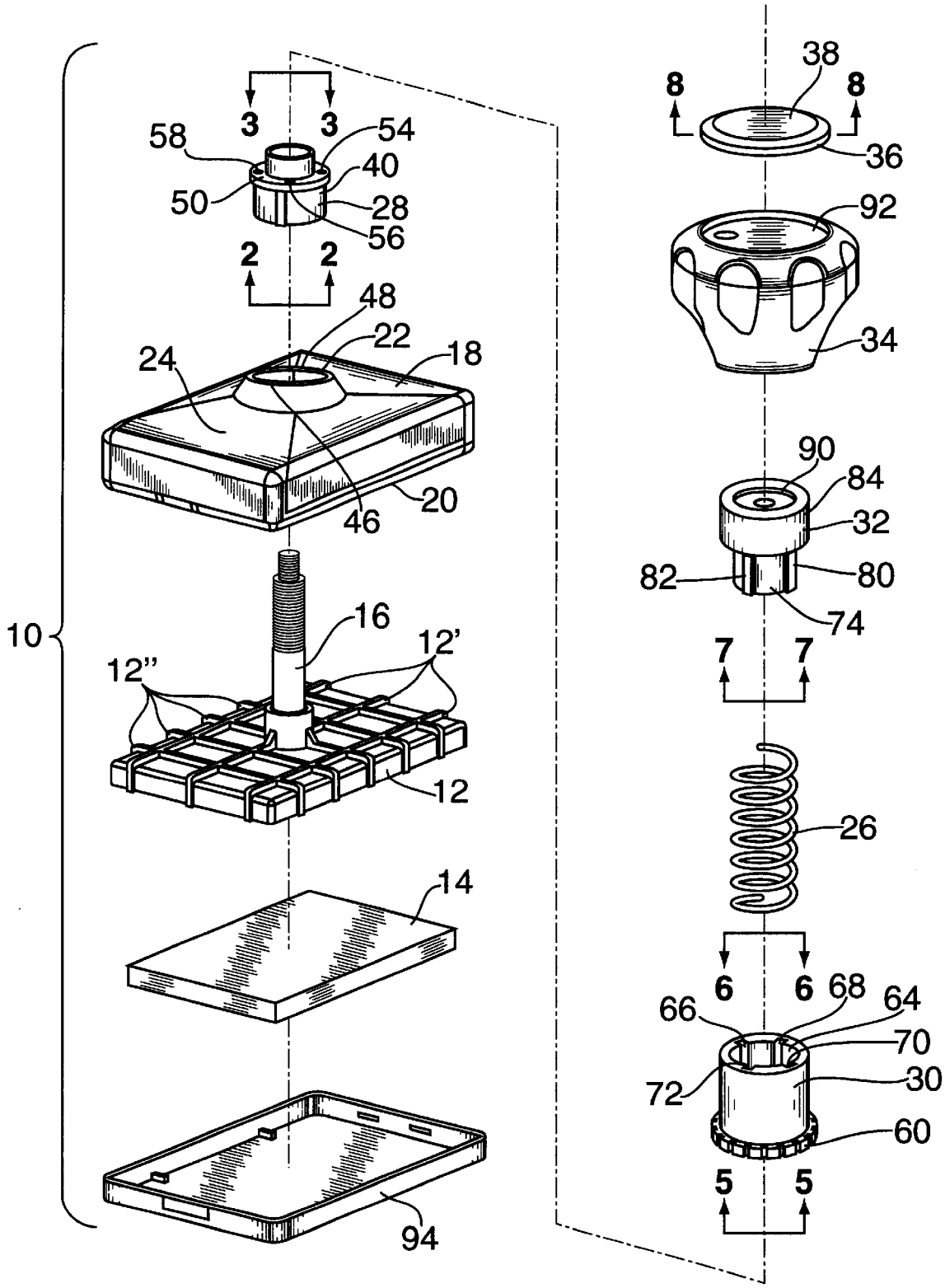
FIG. 1 is an exploded perspective view of a hand stamp according to the invention.
Figure 3:
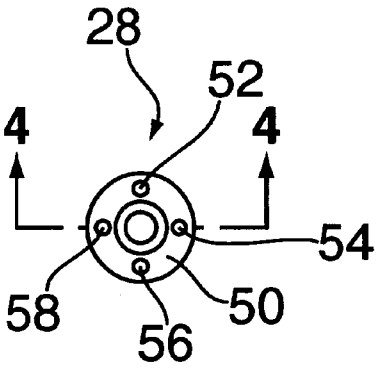
FIG. 3 is top plan view of the lower base member looking in the direction of the arrow B in FIG. 1.
Figure 4:
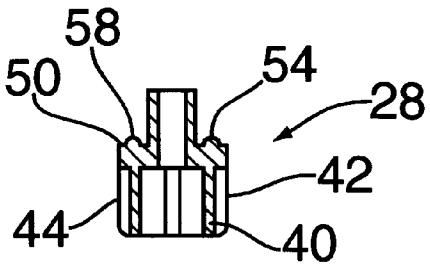
FIG. 4 is a section taken along the line B'—B' in FIG. 3.
Figure 2:
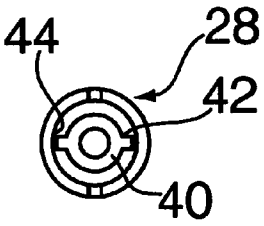
FIG. 2 is a bottom plan view of the lower base member looking in the direction of the arrow A in FIG. 1.
Figure 8:
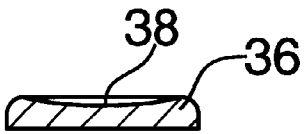
FIG. 8 is a section taken along the line F—F in FIG. 1.
Figure 9:
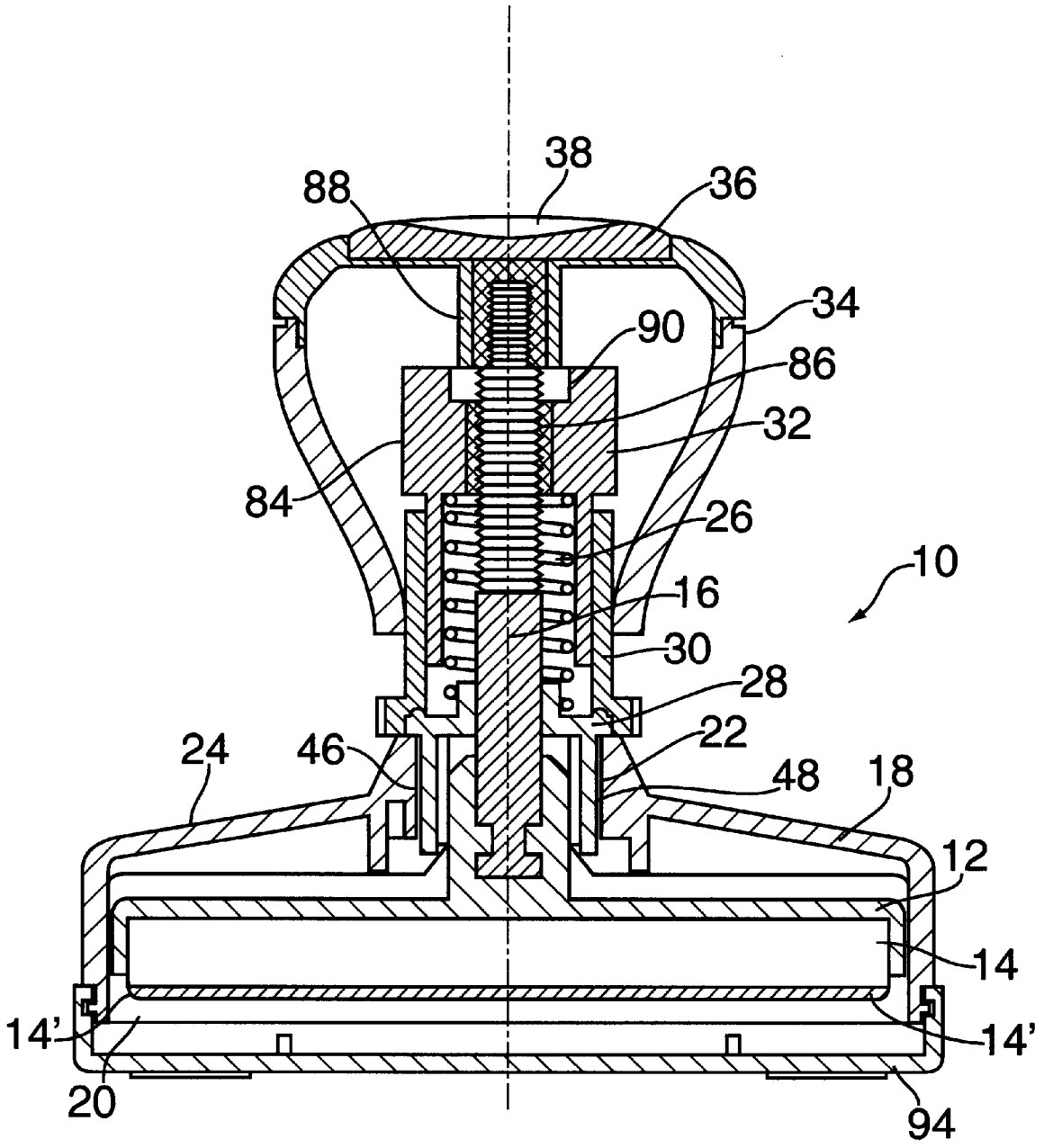
FIG. 9 is a sectional view of the assembled hand stamp of FIG. 1.

Referring now to FIGS. 1 and 9, the pre-inked hand stamp 10 of the present invention includes a platen 12 carrying a microporous imaging member 14 on its lower portion and having a centrally located threaded stem 16 extending upward from its upper portion; an upper case member 18 having an open bottom 20 and a centrally located opening 22 in its top 24, the stem 16 of the platen 12 extending through the centrally located opening 22; a spring 26 and an adjustable stopping assembly (28, 30, 32) coaxially mounted on the stem 16; and a handle 34 threadably coupled to the end of the stem 16. As shown in FIGS. 1, 8, and 9, the handle 34 is provided with a disk insert 36 which has a concave exterior surface 38.

According to the invention, the adjustable stopping assembly includes three members: a lower base member 28 which is mounted in the central opening 22 of the upper case member 18, a rotatable member 30 which is mounted on the lower base member 28, and an upper threaded member 32 which is mounted in the rotatable member 30.

Referring now to FIGS. 1–4, the lower base member 28 is a stepped cylinder, the lower portion 40 of which has a pair of splines 42, 44 which engages a pair of grooves 46, 48 in the central opening 22 of the upper case member 18. A step 50 on the lower base member 28 is provided with four click-stopping bumps 52, 54, 56, 58.

Figure 6:
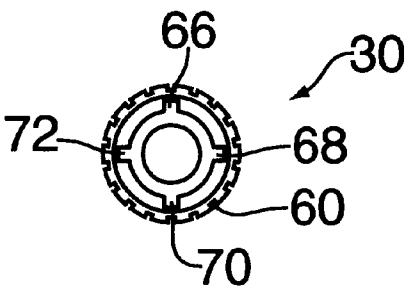
FIG. 6 is a top plan view of the rotatable member looking in the direction of the arrow D in FIG. 1.
Figure 5:
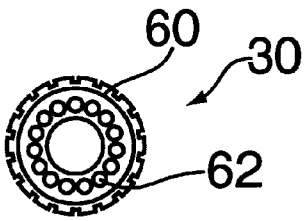
FIG. 5 is a bottom plan view of the rotatable member looking in the direction of the arrow C in FIG. 1.

As shown in FIGS. 1, 5, and 6, the rotatable member 30 is a cylinder with a lower knurled flange 60, the bottom of which forms a base having a plurality of click-stopping depressions, e.g. 62. The interior surface 64 of the rotatable member 30 is provided with four vertical grooves.

Figure 7:
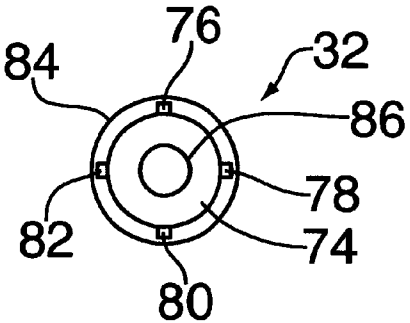
FIG. 7 is a bottom plan view of the upper threaded member looking in the direction of the arrow E in FIG. 1.

Turning now to FIGS. 1 and 7, the upper threaded member 32 is a stepped cylinder, the lower portion 74 of which is dimensioned to fit inside the rotatable member 30. The lower portion 74 of the threaded member 32 is provided with four splines 76, 78, 80, 82, each of which engages a corresponding vertical groove 66, 68, 70, 72 in the rotatable member 30. The upper portion 84 of the threaded member 32 has a diameter which prevents it from entering the rotatable member 30 and has a threaded opening 86 which engages the threaded stem 16. The spring 26 is mounted coaxial to the stem 16 inside the lower portion 74 of the threaded member 32 and biases the threaded member 32 and the rotatable member apart from each other. Moreover, as will become apparent, the spring biases the knurled flange 60 of the rotatable member 30 against the step 50 of the base member 28 causing the click-stopping bumps and depressions to engage each other.

As seen in FIG. 9, the handle 34 has a threaded boss 88 which engages the stem 16 and which is received by a depression 90 in the upper portion 84 of the threaded member 32 (when the threaded member is rotated to the position of maximum stroke). As shown in FIGS. 1, 8, and 9, the handle 34 is provided with an upper depression 92 for receiving a label (not shown) and the clear disk insert 36.

From the foregoing and with reference to all of the Figures generally, those skilled in the art will appreciate that rotation of the rotatable member 30, by gripping the knurled flange 60, causes rotation of the upper threaded member 32, by virtue of the splines 76, 78, 80, 82 and grooves 66, 68, 70, 72 coupling, which results in movement of the upper threaded member 32 along the threaded stem 16. This moves the upper portion 84 of the threaded member 32 relative to the rotatable member 30 changing the permissible stroke of the handle 34.

The fact that the upper threaded member 32 engages the interior of the rotatable member 30 with a spline and groove arrangement prevents lateral movement of the stem 16 relative to the upper case member 18 resulting in a smooth stroke and an even printing. The click-stopping bump(s) 52, 54, 56, 58 and the click-stopping depressions 62*s* prevent unintended rotation of the rotatable member 30 and provide an audible indication of the magnitude of the change of stroke.

According to additional aspects of the invention, the imaging member 14 is provided with curved edges 14' as shown in FIG. 9. Additionally, the platen 12 is reinforced with orthogonal ribs 12' and 12". As mentioned above, the concavity 38 in the disk insert 36 allows the stamp 10 to stand upside down on the handle 34. As with other hand stamps of this type, the assembly 10 also preferably includes a lower case member 94 which snap-fits to the bottom 20 of the upper case member 18, as shown in FIGS. 1 and 9, to prevent dirt from damaging the imaging member 14 when not in use.

There have been described and illustrated herein a pre-inked hand stamp. While particular embodiments of the invention have been described, it is not intended that the invention be limited thereto, as it is intended that the invention be as broad in scope as the art will allow and that the specification be read likewise. Thus, while particular grooves and splines have been disclosed, it will be appreciated that in many cases interchanging the locations of grooves and splines will achieve the same function. Also, while a particular rectangular shape has been shown for the platen and the imaging member, it will be recognized that other shapes including circles, ovals, and polygons could be used. Moreover, while particular configurations have been disclosed in reference to the number of splines and grooves and bumps and depressions, it will be appreciated some different numbers could be used as well. It will therefore be appreciated by those skilled in the art that yet other modifications could be made to the provided invention without deviating from its spirit and scope as so claimed.

What is claimed is:

1. A hand stamp, comprising:

a) a platen having an upper portion and a lower portion;

b) a threaded stem extending from the upper portion of said platen;

c) an upper case member having an open bottom and a top with a centrally located opening, said stem extending through said centrally located opening;

d) a handle threadably coupled to the end of said stem;

e) a spring coaxially mounted on said stem and biasing said handle away from said upper case member; and f) an adjustable stopping assembly mounted coaxial to said stem between said handle and said upper case member, said adjustable stopping assembly being adjustable to change the amount of permissible movement of said handle against said spring towards said upper case member, wherein said adjustable stopping assembly includes i) a lower rotatable member having a knurled flange, and ii) an upper threaded member threadably engaging said threaded stem, said lower rotatable member having a surface provided with first engagement means for engaging said upper threaded member, said first engagement means selected from the group consisting of a spline and a groove, said upper threaded member having a second engagement means for engaging said first engagement means, said second engagement means selected from the group consisting of a spline and a groove, iii) a lower base member mounted in said centrally located opening, said lower base member having a step with a plurality of raised bumps on said step, wherein said knurled flange has a lower surface with a plurality of depressions which engage said plurality of raised bumps.

2. A hand stamp according to claim 1, wherein:

said lower rotatable member and said upper threaded member both include a cylinder, with one cylinder fitting inside the other and with said spring received within said one cylinder, thereby biasing said one cylinder away from the other cylinder.

3. A hand stamp according to claim 2, wherein:

said upper threaded member is a cylinder has a stepped diameter defining a larger diameter upper part and a smaller diameter lower part, said lower rotatable member is a hollow cylinder having an inside diameter closely conforming to said smaller diameter lower part, said lower part fits smoothly inside said lower rotatable member, and said larger diameter upper part is dimensioned to prevent said upper threaded member from passing through said lower rotatable member.

4. A hand stamp according to claim 3, wherein:

said first engagement means comprises a plurality of grooves, and said second engagement means comprises a plurality of splines.

5. A hand stamp according to claim 1, wherein said lower base member has third engagement means for engaging said centrally located opening, said third engagement means selected from the group consisting of a spline and a groove, and said centrally located opening has fourth engagement means for engaging said third engagement means, said fourth engagement means selected from the group consisting of a spline and a groove.

6. A hand stamp according to claim 5, further comprising:

g) an imaging member coupled to the lower portion of said platen, said imaging member having a rounded edge.

7. A hand stamp according to claim 6, further comprising:

h) a concave insert, said handle having a recess for receiving said concave insert.

8. A hand stamp according to claim 7, wherein:

said platen is reinforced by a plurality of orthogonal ribs.

9. A hand stamp according to 8, further comprising:

i) a lower case member removably coupled to said upper case member.

10. A hand stamp according to claim 9, wherein:

said imaging member is a microporous member containing ink.

11. A hand stamp according to claim 10, wherein:

said concave insert is clear.

12. A hand stamp, comprising:

a) a platen having an upper portion and a lower portion;

b) a threaded stem extending from the upper portion of said platen;

c) an upper case member having an open bottom and a top with a centrally located opening, said stem extending through said centrally located opening;

d) a handle threadably coupled to the end of said stem;

e) a spring coaxially mounted on said stem and biasing said handle away from said upper case member; and f) an adjustable stopping assembly mounted coaxial to said stem between said handle and said upper case member, said adjustable stopping assembly being adjustable to change the amount of permissible movement of said handle against said spring towards said upper case member, wherein said adjustable stopping assembly includes an upper threaded member threadably engaging said threaded stem, said upper threaded member comprising a cylinder having a stepped diameter defining a larger diameter upper part and a smaller diameter lower part, a lower rotatable member comprising a knurled flange and a hollow cylinder having an inside diameter closely conforming to said smaller diameter lower part, said lower part fitting inside said lower rotatable member; and said larger diameter upper part is dimensioned to prevent said upper threaded member from passing through said lower rotatable member;

said lower rotatable member having a surface provided with first engagement means for engaging said upper threaded member, said first engagement means comprises a plurality of grooves, said upper threaded engagement means having a second engagement means for engaging said first engagement means, said second engagement means comprises a plurality of splines, said adjustable stopping assembly further including a lower base member mounted in said centrally located opening, said lower base member having a step with a plurality of raised bumps on said step, and wherein said knurled flange has a lower surface with a plurality of depressions which engage said plurality of raised bumps.

* * * * *